US007622082B2

(12) United States Patent
Tanaami

(10) Patent No.: US 7,622,082 B2
(45) **Date of Patent: *Nov. 24, 2009**

(54) BIOCHIP

(75) Inventor: Takeo Tanaami, Musashino (JP)

(73) Assignee: Yokogawa Electric Corporation, Tokyo (JP)

( * ) Notice: Subject to any disclaimer, the term of this patent is extended or adjusted under 35 U.S.C. 154(b) by 516 days.

This patent is subject to a terminal disclaimer.

(21) Appl. No.: 10/237,682

(22) Filed: Sep. 10, 2002

(65) Prior Publication Data

US 2004/0047769 A1 Mar. 11, 2004

(51) Int. Cl.
*B01L 3/00* (2006.01)

(52) U.S. Cl. ..... 422/102; 422/103; 422/104

(58) Field of Classification Search ..... 422/102, 422/103, 104

See application file for complete search history.

(56) References Cited

U.S. PATENT DOCUMENTS

| | | | | |
|---|---|---|---|---|
| 5,290,518 | A * | 3/1994 | Johnson | 422/58 |
| 5,405,510 | A * | 4/1995 | Betts et al. | 205/782 |
| 5,422,271 | A * | 6/1995 | Chen et al. | 435/287.2 |
| 5,747,666 | A * | 5/1998 | Willis | 73/1.02 |
| 6,686,204 | B2 * | 2/2004 | Dubrowny et al. | 436/69 |
| 2001/0016321 | A1 * | 8/2001 | Tanaami | 435/6 |

FOREIGN PATENT DOCUMENTS

| | | | |
|---|---|---|---|
| JP | 60-100055 | A | 6/1985 |
| JP | 6-197751 | A | 7/1994 |
| JP | 8-114539 | A | 5/1996 |
| JP | 11-133027 | A | 5/1999 |
| JP | 2944216 | B2 | 6/1999 |
| JP | 2001-235468 | | 8/2001 |

OTHER PUBLICATIONS

"Popular Science" Aug. 1999.
Japanese Office Action mailed May 22, 2008, issued in corresponding Japanese Application No. 2001-176712.

* cited by examiner

*Primary Examiner*—Jill Warden
*Assistant Examiner*—Natalia Levkovich
(74) *Attorney, Agent, or Firm*—Westerman, Hattori, Daniels & Adrian, LLP.

(57) ABSTRACT

The present invention provides a biochip comprising, in sequence from one end of a blood collection bag formed into a flat, pouch-like shape using a flexible material:

a rubber-like plug which is mounted so as to airtightly close the opening of said blood collection bag and through which a syringe needle is pierced;

a collection block for retaining blood collected through said syringe needle pierced through said plug;

a preprocessing block for isolating targets from said blood; and a junction for combining said targets isolated in said preprocessing block with a plurality of previously prepared probes.

10 Claims, 4 Drawing Sheets

BIOCHIP

BACKGROUND OF THE INVENTION

1. Field of the Invention

The present invention relates to a biochip for testing such substances as DNA, RNA or protein and, in particular, to a biochip that is extremely safe and can reduce the cost of testing.

2. Description of the Prior Art

Methods of testing substances, such as DNA, using biochips have been known well. FIG. 1 is a schematic view showing a conventional system for reading the sequence of a DNA target by scanning a hybridized DNA chip using a biochip reader. The DNA chips shown in FIG. 1, as well as in FIGS. 2 and 3 which are discussed later, are described in "Popular Science"-AUGUST 1999, Times Mirror Magazines, Inc.

In this system, excitation light is radiated at the hybridized DNA chip within biochip 10 and fluorescent light emitted from a fluorescent marker is read using biochip reader 20 so that the sequence of the DNA target, for example, is identified. It should be noted that cartridge 11 is formed using a material that is transparent to the excitation light and fluorescent light.

Biochip 10 in this system is configured in such a manner that substrate 12, on which a multitude of known DNA chips CL are arranged in arrays, is housed within cartridge 11 as shown in FIG. 2. In biochip 10, solution 15 containing target DNA segments previously marked with a fluorescent marker is injected from inlet 13 using solution infusion means 14, such as a pipette, prior to read-out operation, as shown in FIG. 3, so that the DNA segments are hybridized with the probe DNA chip.

On the other hand, such test samples as blood, are sometimes found to be contaminated with a virus such as HIV.

Therefore, there is a growing tendency that for safety reasons, disposable equipment is used for such medical appliances as syringes.

In contrast, the method of introducing a solution shown in FIG. 3 involves the risk of the operator being infected with a virus, such as HIV, as a result of accidental contact with the solution due to mishandling. This risk exists because the method always involves transferring the solution from the solution infusion means 14 or the like to the cartridge 11.

Another problem with the prior art method is that the cost of testing increases since more than one kind of medical equipment must be disposed of, including syringes, appliances used for preprocessing purposes, solution infusion means, DNA chips, and so on.

In the Japanese Laid-open Patent Application 2001-235468 "Biochip," which is a patent application filed by the inventors mentioned in the application concerned, a biochip that has solved the aforementioned problems and can increase safety and reduce test costs is described. This biochip is configured as shown in FIG. 4.

The biochip comprises blood collection tube 31, instead of a conventional spit tube, which is inserted in a syringe cylinder in order to collect blood. The blood collection tube is formed into a cylindrical shape using a solid material transparent to excitation light and fluorescent light produced. The opening of blood collection tube 31 is sealed with a rubber plug 32 whose middle area is pierced with a needle, and blood collection tube 31 as a whole is kept under negative pressure.

Blood collected through the needle is temporarily retained within collection block 33 and then introduced to preprocessing block 34, where the blood is preprocessed. This preprocessing comprises a series of processes, including separating lymphocytes from the blood, isolating DNA from the separated lymphocytes, and adding a fluorescent marker to the isolated DNA.

Housed in the innermost section of blood collection tube 31 is substrate 35, similar to the one shown in FIG. 1, on which probe DNA segments are arranged in arrays. In the innermost section, DNA segments that infiltrate from preprocessing block 34 and the probe DNA segments are hybridized.

It is understood that such a biochip as discussed above is advantageous in that processes, from blood collection to preprocessing and hybridization, are run consistently and automatically. However, the biochip requires the use of a rigid blood collection tube and is therefore costly. Another problem is that the biochip requires the use of a suction pump in order to keep the blood collection tube under negative pressure, thus resulting in the system as a whole being significantly expensive.

SUMMARY OF THE INVENTION

An object of the present invention is to provide a biochip that can protect an operator from the risk of accidentally coming into contact with a solution due to mishandling, and that is easy to operate and inexpensive, thus solving the aforementioned problems.

In order to achieve the aforementioned object, a biochip as defined in claim 1 of the present invention is integrally constructed by arranging, in sequence from one end of a blood collection bag formed into a flat, pouch-like shape using a flexible material:

- a rubber-like plug which is mounted so as to airtightly close the opening of the blood collection bag and through which a syringe needle is pierced;
- a collection block for retaining blood collected through the syringe needle pierced through the plug;
- a preprocessing block for isolating targets from the blood; and
- a junction for combining the targets isolated in the preprocessing block with a plurality of previously prepared probes.

With such a biochip configuration as described above, it is possible to fabricate the blood collection bag using an inexpensive material and, therefore, the bag becomes less costly. Furthermore, the present invention does not require a pump or the like for drawing blood which the prior art biochip would require. Consequently, it is possible to realize a biochip that is inexpensive overall.

DETAILED DESCRIPTION OF THE PREFERRED EMBODIMENTS

Figure 5A:
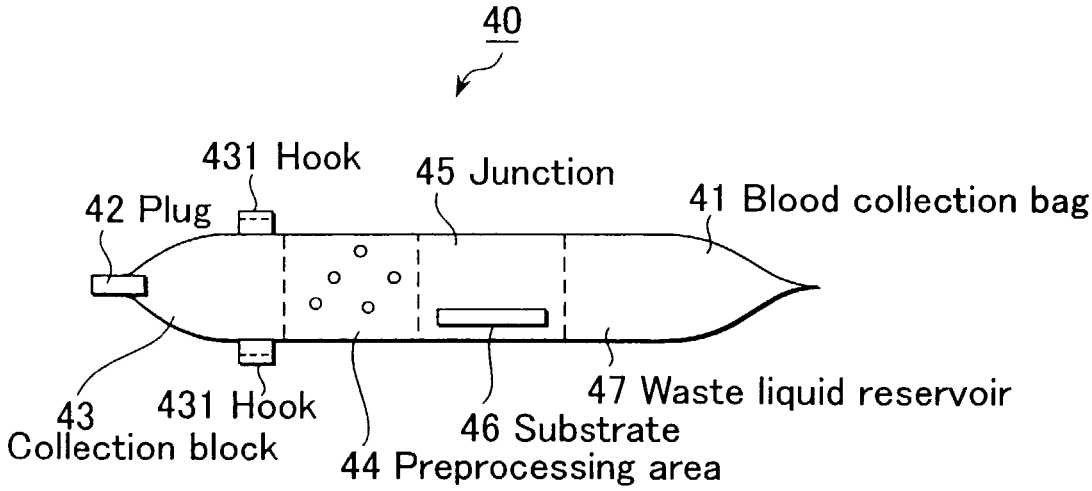
FIGS. 5(A) and 5(B) are schematic views showing one embodiment of a biochip in accordance with the present invention.
Figure 5B:
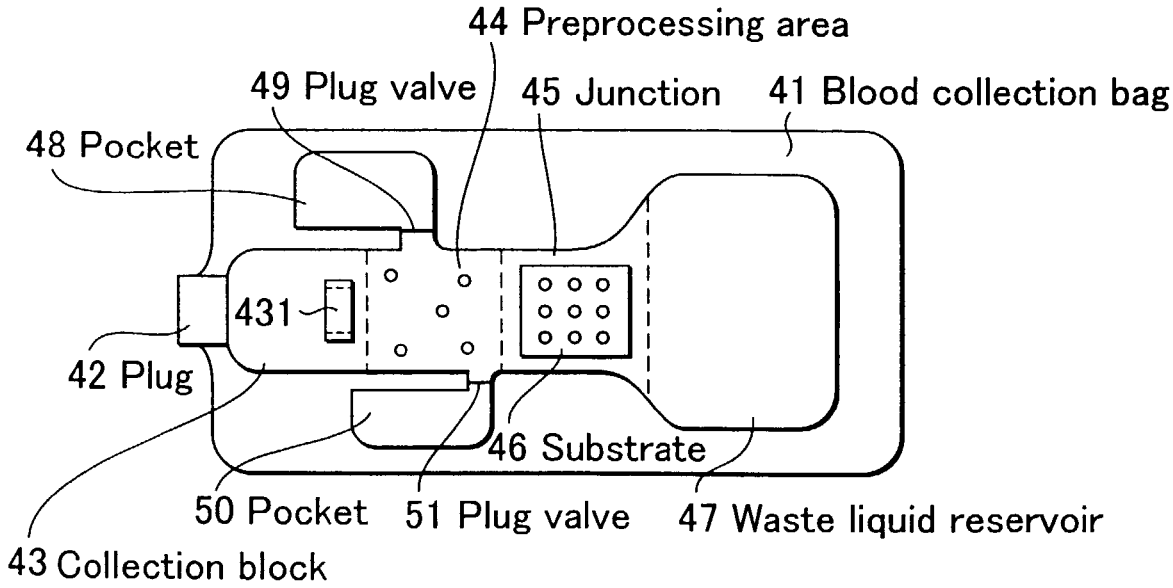

Now the present invention will be described in detail with reference to the accompanying drawings. FIG. 5 is a schematic view showing one embodiment of a biochip in accordance with the present invention, wherein FIG. 5(*a*) is a side view, while FIG. 5(*b*) is a plan view.

Figure 1:
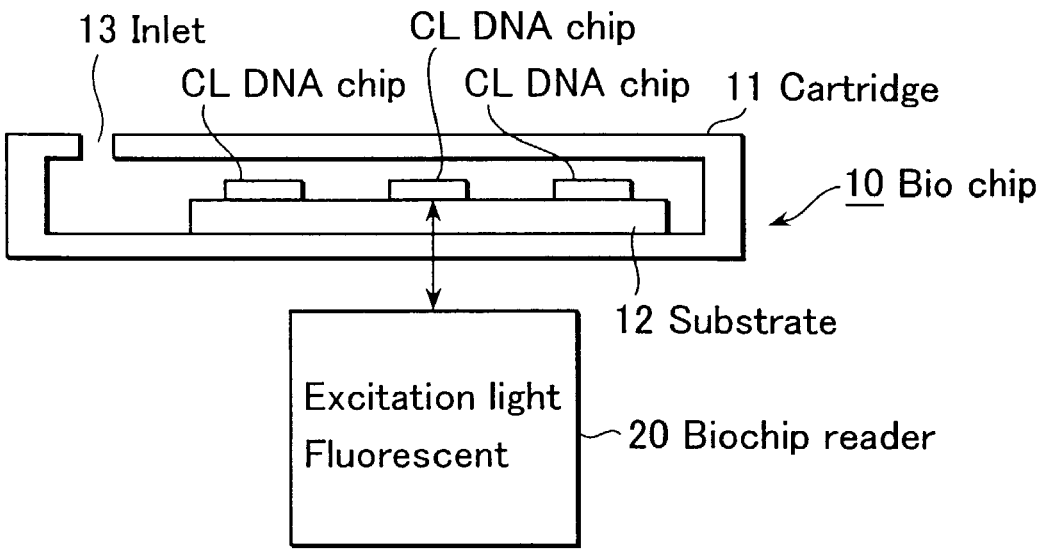
FIG.1 (PRIOR ART)
FIG. 1 is a schematic view showing an example of a prior art biochip.
Figure 2:
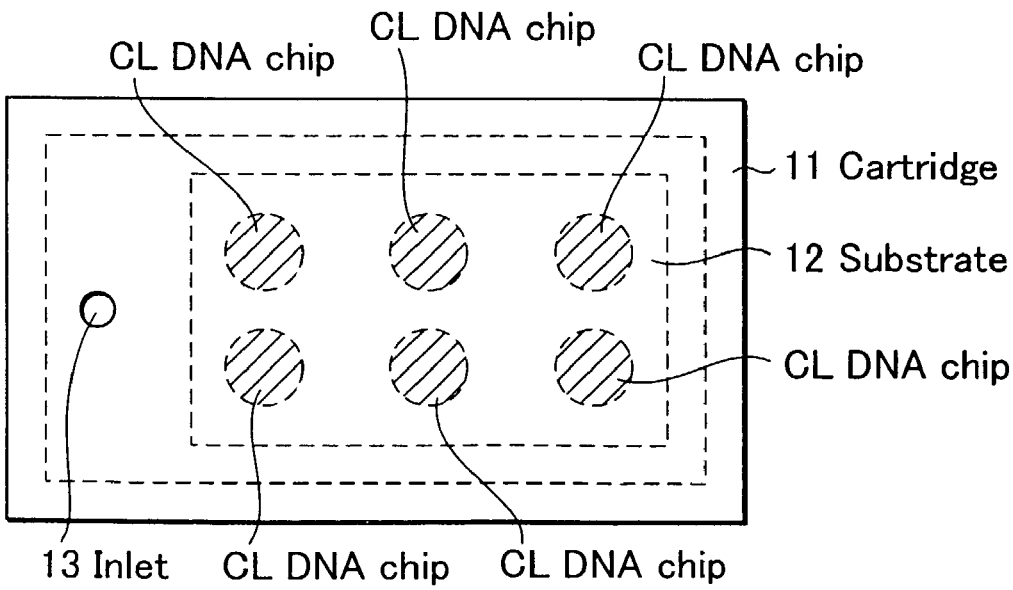
FIG.2 (PRIOR ART)
FIG. 2 is a plan view of the biochip of FIG. 5.
Figure 3:
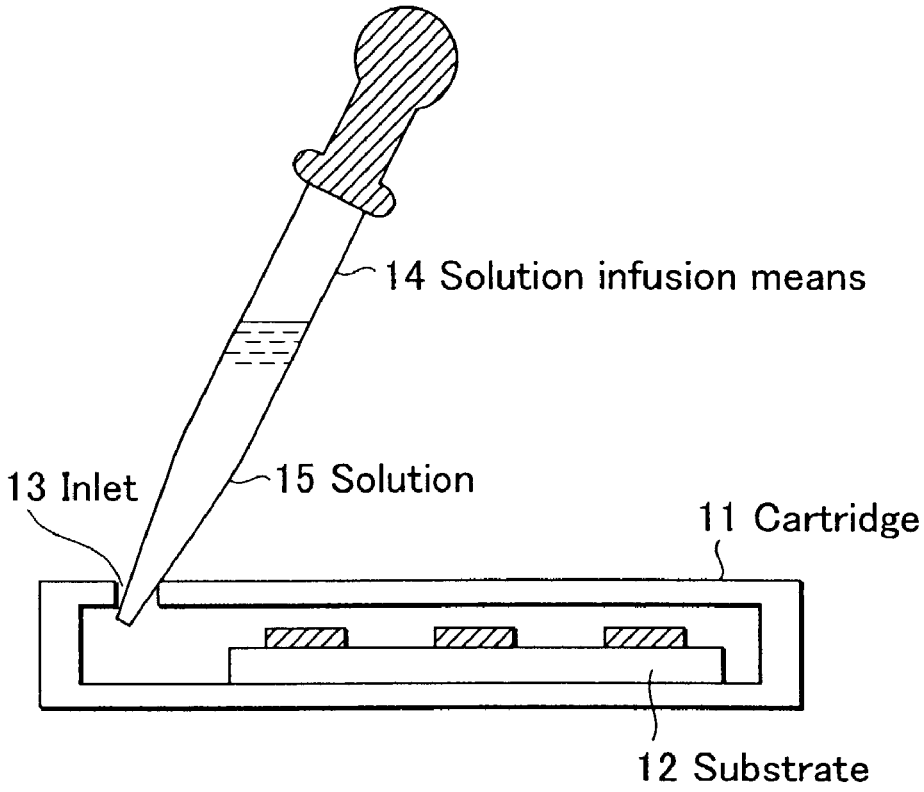
FIG.3 (PRIOR ART)
FIG. 3 is a schematic view showing the way a solution is injected into the prior art biochip.
Figure 4:
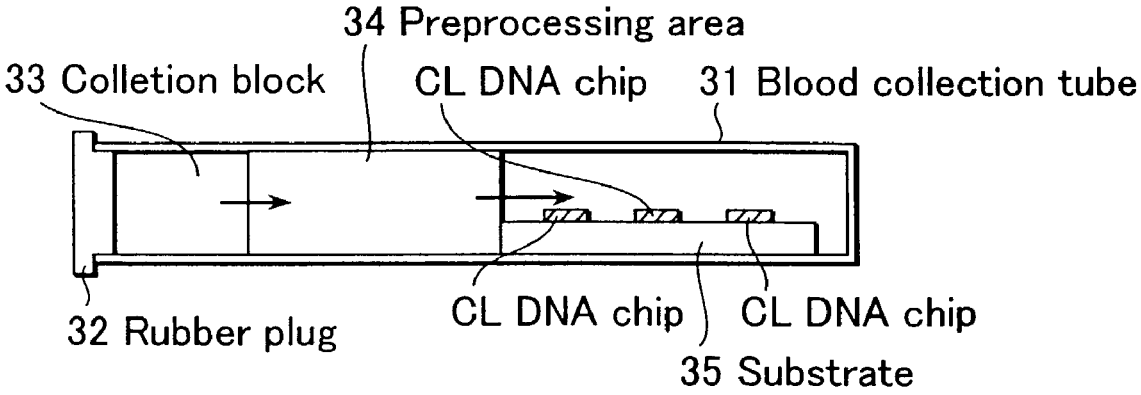
FIG.4 (PRIOR ART)
FIG. 4 is a schematic view showing the configuration of another example of the prior art biochip.

While blood collection tube 31 shown in FIG. 4 is formed into a cylindrical shape using a rigid material, biochip 40 of the present invention has good flexibility and is formed into a flat, airtight bag-like shape, using a material transparent to fluorescent light and excitation light.

Blood collection bag 41 has a rectangular outline, as shown in the plan view of FIG. 5(*b*), and the periphery of the bag is sealed airtightly. The middle area of the bag is shaped like a fish. The bag's opening, which corresponds to the mouth of a fish, is closed airtight with plug 42. Plug 42 is formed using a rubber-like material and a syringe needle is pierced through plug 42 at the time of blood collection. When the syringe needle is pulled out after blood collection, the pinhole thus opened immediately closes, preventing the collected blood from leaking out of the biochip.

In sequence from plug 42 to the innermost section of the biochip, collection block 43, preprocessing block 44, junction 45, and waste liquid reservoir 47 are formed in blood collection bag 41.

Collected blood is stored in collection block 43. Hooks 431 are formed on both the top and bottom sides of the jacket of collection block 43. At the time of blood collection, collection block 43 is expanded by pulling outwards arm engaged with these hooks 431.

In preprocessing block 44, a process of isolating targets of interest from the collected blood is executed. Junction 45 is provided with substrate 46, on which a plurality of probes (herein assumed to be DNA) are arranged in arrays, so that targets isolated in preprocessing block 44 can be combined complementarily with the probes.

Waste liquid reservoir 47 is a pocket provided in order to retain an unnecessary solution forcibly driven out of preprocessing block 44 and junction 45. The pocket is compressed in its initial state.

Pockets 48 and 50 corresponding to the dorsal and abdominal fins of a fish are formed on the sides of preprocessing block 44 so as to oppose to each other. Solutions necessary to isolate targets (DNA, RNA or protein) from blood are encapsulated in pockets 48 and 50, respectively.

Plug valves 49 and 51 serving as bulkheads are formed in junctions (narrow passages) between pocket 48 and preprocessing block 44 and between pocket 50 and preprocessing block 44. These valves are designed to break when the pressure of solutions within the pockets rises to a given level.

The method by which the thus configured blood collection bag 41 is used and the functions of the bag will now be explained by referring to FIG. 6.

Figure 6:
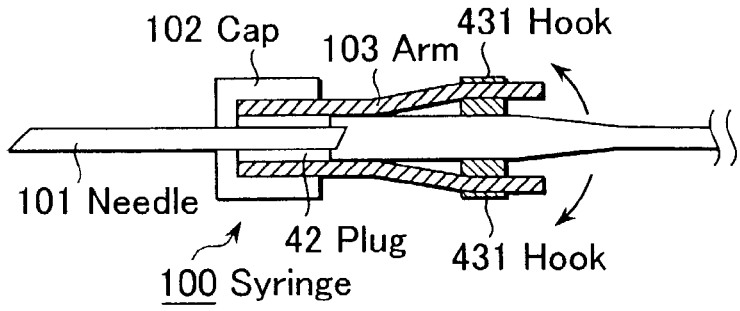
FIG. 6 is a schematic view showing the configuration of a joint for coupling a syringe with a blood collection bag.

FIG. 6 is a schematic view showing the configuration of a connection point where syringe 100 is coupled with blood collection bag 41.

Syringe 100 consists of syringe needle 101, cap 102, and arm 103. Syringe needle 101 is mounted so as to penetrate through cap 102. The portion of syringe needle 101 that protrudes toward the open end of cap 102 is just long enough to penetrate through plug 42 of blood collection bag 41 when the bag is inserted from the open end of cap 102.

Arm 103 are designed to expand collection block 43 of blood collection bag 41, and are made of a flexible material. One end of arm 103 is fixed to cap 102, and an engagement part (not shown in the figure) for engaging with hook 431 on collection block 43 of blood collection bag 41 is formed on the other end of arm 103. A known means can be adopted as the engagement part.

It should be noted that blood collection bag 41 is configured so that when mounted on syringe 100, the arm automatically engage with hooks 431.

Needle 101 of such syringe 100 as described above is inserted into an arm of a person being tested. Then, blood is collected into collection block 43 by gradually opening arm 103 so that the inside of collection block 43 is negatively pressurized.

After blood collection, blood collection bag 41 is decoupled from syringe 100, and then syringe 100 is removed from the arm of the person being tested.

Figure 7:
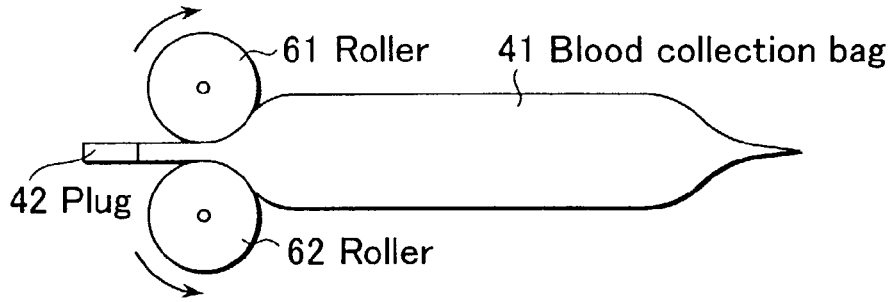
FIG. 7 is a schematic view showing the way the biochip is operated.

After collecting blood as described above, blood collection bag 41 is pinched between rollers 61 and 62 that rotate as shown in FIG. 7, so that the bag is squeezed in the direction from collection block 43 toward preprocessing block 44.

The axial length of rollers 61 and 62 is made to be greater than the width of blood collection bag 41, so that the rollers pressurize the overall width of blood collection bag 41 in a uniform manner.

For the reason that a known drive mechanism is used to drive rollers 61 and 62 and for the purpose of simplifying the description, the drive mechanism is not illustrated here.

As rollers 61 and 62 rotate, the collected blood is forced to move toward preprocessing block 44.

When rollers 61 and 62 advance and begin squeezing pocket 48, the internal pressure thereof rises and therefore plug valve 49 breaks. When plug valve 49 breaks, a solution within pocket 48 flows into preprocessing block 44, where a given process based on the solution is executed.

Then, when pocket 50 is also squeezed by rollers 61 and 62, plug valve 51 likewise breaks and a solution within pocket 50 flows into preprocessing block 44, where a given process is executed.

Consequently, it is possible to easily submit blood collection bag 41 to time-differentiated processing by displacing the mounting positions of the pockets from each other.

In other words, it is possible to submit the bag to the process of separating lymphocytes from blood and isolating DNA from the lymphocytes thus separated and the process of, for example, adding a fluorescent marker to the isolated DNA, with a time difference provided between these processes.

When the process in preprocessing block 44 is completed, then rollers 61 and 62 are rotated further. This operation feeds the preprocessed blood toward junction 45, where hybridization with probe DNA chips arranged on substrate 46 takes place.

It should be noted that extra amounts of blood and solution forcibly driven out of preprocessing block 44 accumulate in waste liquid reservoir 47.

DNA chips that have undergone hybridization are read in the same way as the conventional method, using a biochip reader (not shown in the figure).

As described heretofore, processes from blood collection to preprocessing and hybridization are executed consistently within a hermetically sealed blood collection bag. Therefore, it is possible to prevent accidental contact with solutions due to mishandling.

In addition, since such a blood collection bag as described above can be easily fabricated using a flexible inexpensive material, it is possible to easily realize an inexpensive biochip.

It should be noted that the present invention is by no means limited to the aforementioned preferred embodiment. Those skilled in the art will recognize various changes and modifications that may be made without departing from the spirit of the present invention. Therefore, the appended claims shall be construed as covering the embodiment mentioned herein and all such changes and modifications as fall within the spirit and scope of the invention.

Figure 8:
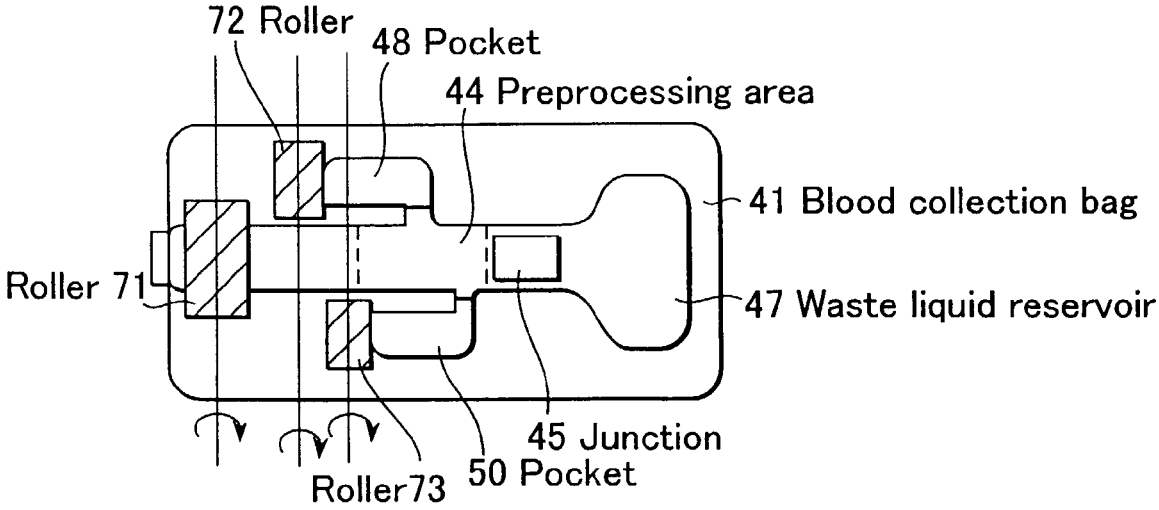
FIG. 8 is a schematic view showing another embodiment of the present invention.

For example, the roller is not limited to the configuration discussed in the aforementioned embodiment. Alternatively, the roller may be split into three rollers 71, 72 and 73, as shown in FIG. 8, for allocation to the three parts of the blood collection bag corresponding to the middle portion, dorsal fin, and abdominal fin of a fish. Furthermore, these rollers may be arranged with their positions displaced from each other as necessary. Splitting and arranging the roller in such a manner makes it possible to submit the biochip to increasingly complex, time-differentiated processing.

Although DNA was mentioned as the sample in the above-described embodiment and the case where DNA was isolated in the preprocessing block was explained, the sample is not limited to DNA. Alternatively, the sample may be RNA or protein.

Methods of engaging the jacket of collection block 43 with arm 103 of syringe 100 are not limited to the above-described embodiment, either. Alternatively, a method of joining the jacket of collection block 43 and arm 103 with an adhesive agent may be employed, for example.

Test samples to be obtained are not limited to blood. Alternatively, the test sample may be such a solution as has been prepared by isolating a testpiece from a pathologically affected area and then homogenizing the testpiece.

Means for detecting an isolated biopolymer, such as DNA, is not limited to fluorescence. Alternatively, calorimetric means or current-based means, such as an intercurrenter may be used as the detection means.

As described heretofore, the present invention provides the following advantages:

(1) It is possible to execute a series of processes, from preserving blood in a collection block to preprocessing and hybridizing the blood, all within a hermetically sealed blood collection bag. Consequently, it is possible to prevent the blood from leaking out of the bag during processing and thereby eliminate the risk of coming into contact with the blood.

(2) An inexpensive material can be used for the blood collection bag. Consequently, it is possible to easily fabricate biochips that are more economical than the prior art biochip.

(3) It is possible to feed the sample into the preprocessing block or hybridization process block by simply squeezing the blood collection bag from one end toward the other end thereof by means of, for example, a roller or rollers.

Consequently, there is no need for any complex mechanism, such as a suction pump, for transferring the sample, as seen in the prior art.

What is claimed is:

1. A biochip, comprising: a blood collection bag;

a plug made from flexible material which airtightly closes an opening of the blood collection bag;

said blood collection bag having formed in sequence from one end of said blood collection bag to another end:

a collection block directly connected to said plug;

a preprocessing block in communication with said collection block, a junction in communication with said preprocessing block, wherein the junction includes a substrate having a plurality of probes arranged in arrays, a pocket formed on a side of said preprocessing block in which solution is encapsulated and said pocket is in communication with said preprocessing block via a passage;

wherein said blood collection bag is formed of compressible material;

wherein said collection block, preprocessing block, pocket, and junction are positioned so that compression directed from said collection block toward said preprocessing block causes blood to flow from said collection block through said communication to said preprocessing block, and simultaneously said compression causes the solution encapsulated in said pocket to flow into said preprocessing block and further flows said blood and solution in said processing block through the communication with the junction; wherein said passage is formed at a furthest downstream position of the pocket.

2. The biochip of claim 1, wherein said blood collection bag is formed using a material transparent to excitation light and fluorescent light.

3. The biochip of claim 2 wherein said collection block is in fluid communication with said preprocessing block and said preprocessing block is in fluid communication with said junction; and, means for communicating a fluid by application of said compression which is applied to said fluid wherein said fluid enters said collection block through said opening proceeds through said collection block to said preprocessing block and proceeds through said preprocessing block to said junction.

4. The biochip of claim 3, wherein said preprocessing block comprises means for isolating one or more of the group consisting of DNA, RNA and protein.

5. The biochip of claim 1, further comprising: a plug valve formed in said passage;

wherein said plug valve opens and said solution in said pocket is fed into said preprocessing block upon application of said compression to said pocket.

6. The biochip of claim 5, comprising a plurality of said pockets which are arranged in different positions so that upon application of said compression, solutions are fed from said pockets flow into said preprocessing block at different times.

7. The biochip of claim 1, further comprising: a waste liquid pocket in communication with said junction.

8. The biochip of claim 7, wherein said collection block of said blood collection bag is provided with at least two hooks located on opposite outer side surfaces of the blood collection bag for expanding the collection block by pulling said hooks in opposite directions so as to create negative pressure within said blood collection bag.

9. A biochip comprising: a bag including:

a collection block for retaining liquid in the bag formed using a flexible material;

a preprocessing block adjacent to said collection block;

a first pocket connected to said preprocessing block via a passage, which is filled with a first solution for preprocessing purposes;

wherein said collection block and said first pocket are formed of compressible material and are positioned so that compression on said collection block and said first pocket toward said preprocessing block causes said liquid to be fed to said preprocessing block and said first solution to be fed into said preprocessing block; wherein said passage is formed at a furthest downstream position of the first pocket; wherein said liquid in said preprocessing block is fed to a junction by compression directed from said collection block toward said preprocessing block and wherein the junction includes a substrate having a plurality of probes arranged in arrays.

10. The biochip according to claim 9, wherein said first pocket is formed on one side of said preprocessing block; and further comprising:

a second pocket which is filled with a second solution and is formed on another side of said preprocessing block and leading to said preprocessing block, wherein a position of said first pocket fitted to said preprocessing block is different from a position of said second pocket fitted to said preprocessing block; and wherein said first pocket and said second pocket are formed of compressible material so that uniform compression directed from said collection block toward said preprocessing block, causes said first solution and second solution to be fed into said preprocessing block consecutively.

* * * * *